US005139435A

United States Patent [19]

Komatsu et al.

[11] Patent Number: 5,139,435

[45] Date of Patent: Aug. 18, 1992

[54] MULTIPOLAR ELECTRICAL CONNECTOR

[75] Inventors: Yasuhiro Komatsu, Osaka; Masahiko Umekawa, Tondabayashi, both of Japan

[73] Assignee: Hosiden Corporation, Yao, Japan

[21] Appl. No.: 796,014

[22] Filed: Nov. 22, 1991

[30] Foreign Application Priority Data

Dec. 4, 1990 [JP] Japan ..... 2-400073[U]

[51] Int. Cl.[5] ..... H01R 13/635

[52] U.S. Cl. ..... 439/159

[58] Field of Search ..... 439/152-160

[56] References Cited

U.S. PATENT DOCUMENTS 4,914,552 4/1990 Kecmer ..... 439/157

4,996,631 2/1991 Freehauf ..... 439/157

5,051,101 9/1991 Komatsu ..... 439/159

*Primary Examiner*—Joseph H. McGlynn

*Attorney, Agent, or Firm*—Jones, Tullar & Cooper

[57] ABSTRACT

The electrical connector according to the present invention is adapted to guide a card in the front-to-back direction thereof by left- and right-hand guides projecting from the electrical connector body. The electrical connector body incorporates a card ejecting mechanism, which comprises a swingable cam, a card pushing portion formed at the cam, and a lever connected to a mounting portion of the cam. The ejecting mechanism having the arrangement above-mentioned does not project on and under the electrical connector, thus enabling the electrical connector to be made thin and in small sizes.

13 Claims, 4 Drawing Sheets

MULTIPOLAR ELECTRICAL CONNECTOR

BACKGROUND OF THE INVENTION

1. Field of the Invention

The present invention relates to a multipolar electrical connector for connecting multipolar contacts of a card which belongs to the field of IC memory cards or the like, to multipolar contacts of a computer or the like.

Recently, it is increasingly demanded to make, in smaller sizes, a computer and its relevant device using a card of the type above-mentioned. In this connection, the electrical connector is also required to be as thin as 5 to 6 mm. In such a thin electrical connector, a card ejecting mechanism is often disposed to enhance the maneuverability for removing the card.

2. Description of the Invention

Thus, such a card ejecting mechanism is formed in the following manner. That is, the electrical connector incorporates a slide plate provided at the front end thereof with a pair of pawl pieces adapted to be respectively engaged with two left- and right-hand portions of the front end surface of a card, and the slide plate is connected to a lever serving as an actuator.

With the ejecting mechanism having the arrangement above-mentioned, when the lever is operated to retreat the slide plate, the card set in the electrical connector is rearwardly pushed, evenly at the two left- and right-hand portions of the front end thereof, by a pair of pawl pieces, so that the card can be pulled out from the electrical connector.

In this ejecting mechanism, however, if the slide plate having a pair of pawl pieces is thick or long, the electrical connector inevitably becomes thick or long. Thus, restrictions are imposed on the configuration of the electrical connector, failing to make the electrical connector thin and in small sizes as required.

SUMMARY OF THE INVENTION

In view of the foregoing, the present invention is proposed with the object of providing an electrical connector having an ejecting mechanism formed without the use of a member such as the slide plate above-mentioned which prevents the electrical connector from being made thin and in small sizes.

To achieve the object above-mentioned, the electrical connector according to the present invention comprises:

contact pin groups;

an electrical connector body from which said contact pin groups project;

guides rearwardly extending from said electrical connector body at the ends of both lateral sides thereof, said guides being adapted to guide, in the front-to-back direction, a card provided in the front end surface thereof with pin insertion holes corresponding to said contact pin groups, while said guides respectively come in slide contact with both lateral sides of said card;

a cam swingably pin-connected to said electrical connector body at the end of the left or right side thereof;

a card pushing portion formed on said cam at a portion thereof, said card pushing portion being adapted to be moved toward or away from one end side of a card setting space in the right-to-left direction thereof when said cam is swung, said card setting space being formed between said left- and right-hand guides; and a mounting portion formed on said cam at another portion thereof and connected to an actuator for swinging said cam.

In the electrical connector having the arrangement above-mentioned in accordance with the present invention, when a card is set in the card setting space and the cam is then swung so that the card pushing portion of the cam projects toward one end side of the space in the right-to-left direction, the card is pushed at the front end thereof by the card pushing portion, so that the card is retreated and pushed out in the card removing direction. On the other hand, when the card pushing portion of the cam projects toward one end side of the space in the right-to-left direction and a card is then set into the space, the front end of the card pushes the card pushing portion to swing the cam, so that the card pushing portion is moved away from the space.

Thus, according to the present invention, the ejecting mechanism can be added to the electrical connector merely by providing the electrical connector body with a cam having a card pushing portion and a mounting portion connected to an actuator. Even though such an ejecting mechanism is added, the electrical connector is not prevented from being made thin and in small sizes. Further, even though the card is pushed only at one transverse end of the front end surface thereof, the card is guided in the front-to-back direction thereof by two left- and right-hand guides. Accordingly, the card can be securely removed straight. Thus, there can be provided an economical and small-size multipolar electrical connector excellent in card-removing properties.

According to the present invention, the actuator of the electrical connector may be a lever disposed along and outside of one of the left- and right-hand guides, and the intermediate portion of the lever in the front-to-back direction is fitted, slidably in the front-to-back direction, to lever holding portions which project outwardly from the guide along which the lever extends.

In the electrical connector having the arrangement above-mentioned, the operation of the lever in the front-to-back direction interlocks with the swing of the cam. This increases the degree of freedom in designing for incorporating the electrical connector in a device concerned, or in production of the electrical connector.

According to the present invention, the actuator of the electrical connector may be an operating knob disposed along and outside of one of the left- and right-hand guides, and the operating knob is exposed from the housing of a device incorporating the multipolar electrical connector of the present invention.

In the electrical connector having the arrangement above-mentioned, the operation of the operating knob interlocks with the swing of the cam. This increases the degree of freedom in designing for incorporating the electrical connector in a device concerned, or in production of the electrical connector. Further, even though the electrical connector having the ejecting mechanism is incorporated in a device concerned, such incorporation hardly prevents the device from being made in small sizes.

According to the present invention, each of the left- and right-hand guides of the electrical connector may have a thickness substantially equal to that of a card, and a printed circuit board and/or a housing may be transversely disposed between the left- and right-hand guides.

In the electrical connector having the arrangement above-mentioned, the left- and right-hand guides are used just for preventing the positional shift of a card in the right-to-left direction when inserting or removing the card. The positional shift of the card in the thickness direction is prevented by the printed circuit board and/or the housing. This reduces the electrical connector in entire thickness to the extent substantially equal to that of the card.

According to the present invention, the cam of the electrical connector may be made of synthetic resin.

In the electrical connector above-mentioned, there is no likelihood that the cam is electrically short-circuited with the contact pins forming the contact pin groups, and that the contact pins are damaged.

Other features and operational effects of the present invention will be apparent from the following description with reference to attached drawings illustrating embodiments thereof.

DETAILED DESCRIPTION OF THE PREFERRED EMBODIMENTS

Figure 1:
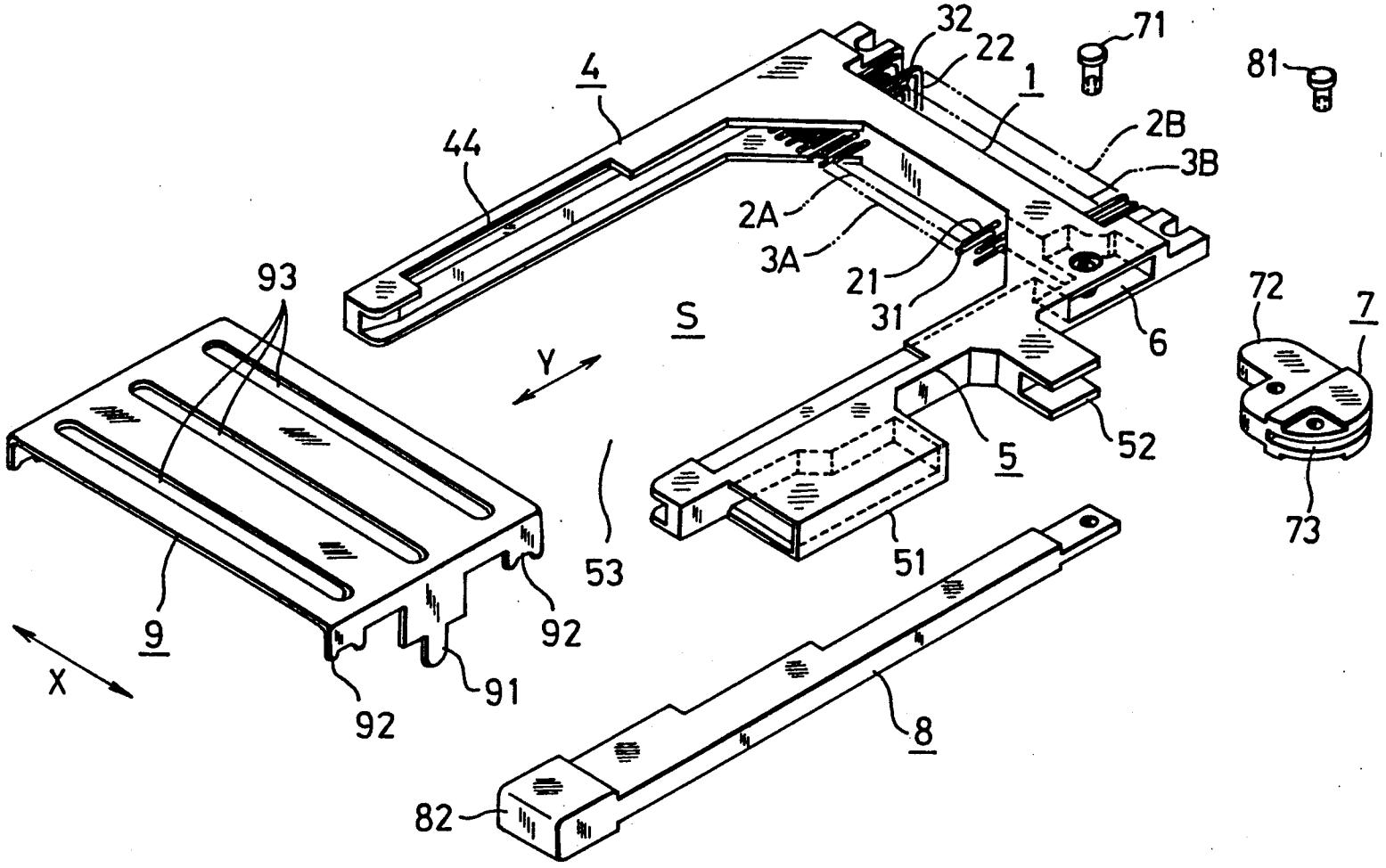
FIG. 1 is an exploded perspective view of an electrical connector in accordance with an embodiment of the present invention.
Figure 2:
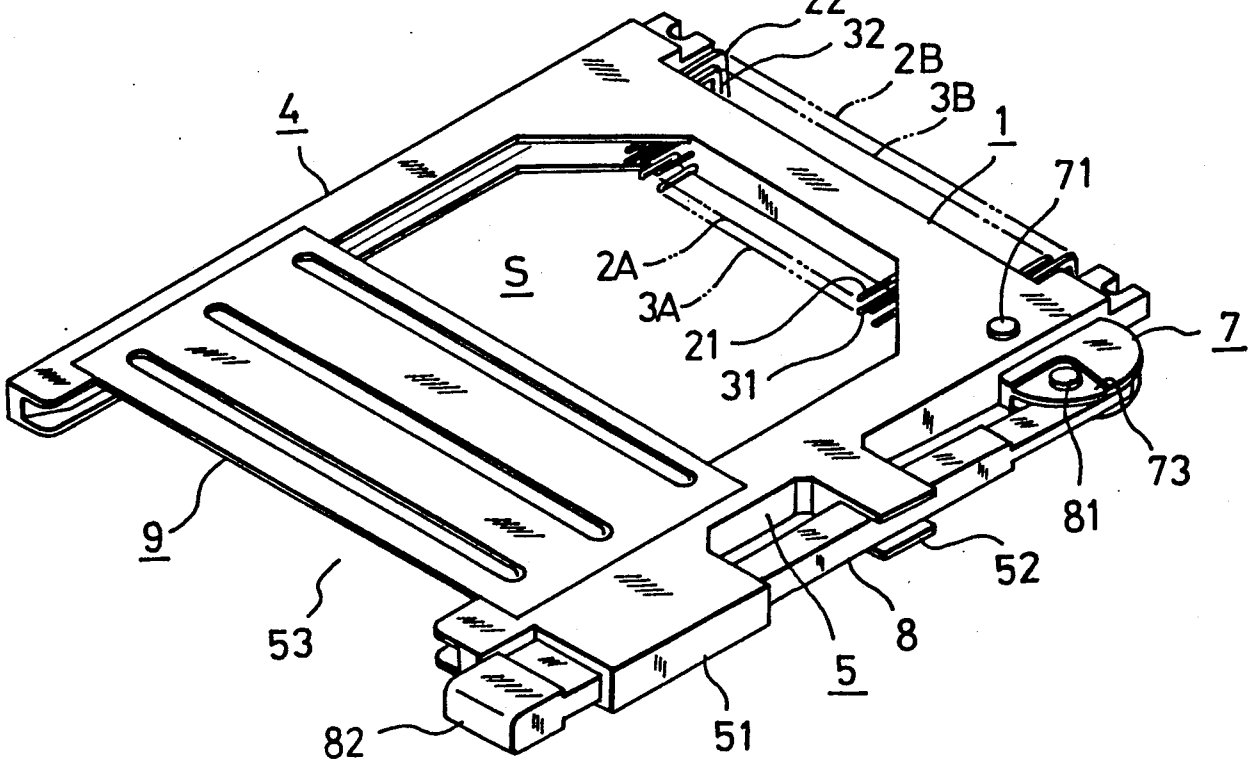
FIG. 2 is an appearance of the electrical connector in accordance with the present invention.
Figure 3:
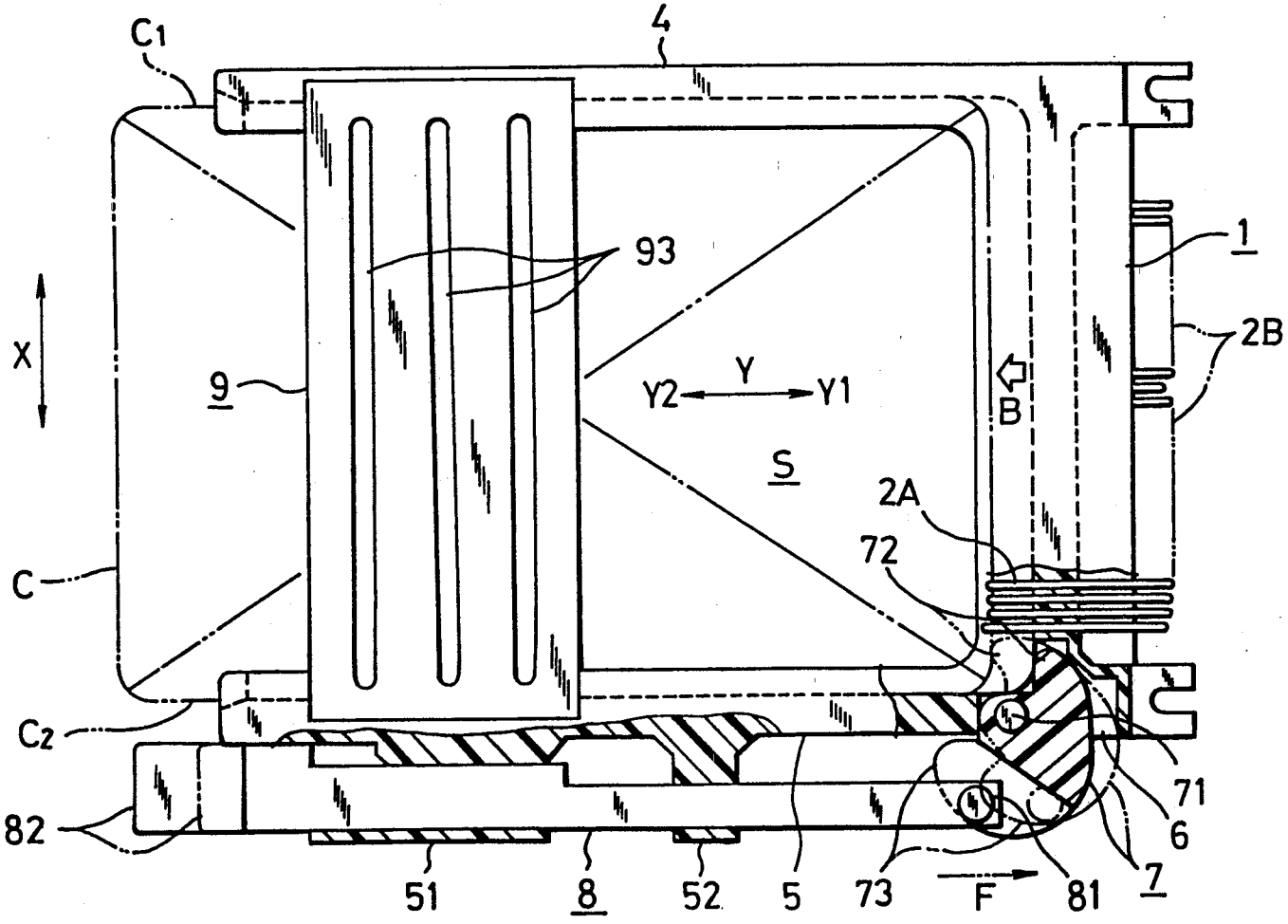
FIG. 3 is a plan view, with portions broken away, of the electrical connector in accordance with the present invention.

In FIGS. 1, 2 and 3, an electrical connector of the present invention has a body 1 made of insulating synthetic resin and having a front end surface substantially made in the form of a rectangle. The electrical connector body 1 has, in two (upper and lower) rows, a number of contact pins 21, 31 at regular intervals. These contact pins 21, 31 project rearwardly. Terminals 22, 32 respectively extend from the contact pins 21, 31 and are introduced forward of the electrical connector body 1 after passing therethrough. A number of contact pins 21 at the upper row and a number of contact pins 31 at the lower row respectively form contact pin groups 2A, 3A. The terminals 22 extending from a number of contact pins 21 at the upper row form a terminal group 2B, while the terminals 32 extending from a number of contact pins 31 at the lower row form a terminal group 3B.

A groove-shape guide 4 projects from the end of the left side of the electrical connector body 1, and a groove-shape guide 5 projects from the end of the right side of the electrical connector body 1. The distance between the groove bottoms of these guides 4, 5 is substantially equal to the width of a card C in the right-to-left direction X thereof. The length of each of the guides 4, 5 in the front-to-back direction Y is slightly shorter than the entire length of the card C in the front-to-back direction Y. Accordingly, when the lateral sides C1, C2 of the card C are respectively fitted in the guides 4, 5, the lateral sides C1, C2 come in slide contact with the guides 4, 5, so that the card C is securely guided in the front-to-back direction.

The electrical connector body 1 is provided at the right-hand end thereof with a concave 6. As shown in FIG. 3, the concave 6 is opened to a card setting space S formed between the left- and right-hand guides 4, 5. A cam 7 made of synthetic resin is housed in the concave 6 and is pin-connected to the electrical connector body 1 with a pin 71 such as a rivet. The cam 7 has a card pushing portion 72 as projecting therefrom. At the opposite side to the card pushing portion 72, the cam 7 has a mounting portion 73 which is connected to a lever 8 serving as an actuator.

The cam 7 is swingable around the pin 71. When the cam 7 is swung, the card pushing portion 72 projects in a rearward direction Y2 at one end side of the space S in the right-to-left direction X (i.e., at the right-end side of the space S), as shown by a virtual line in FIG. 3, or the card pushing portion 72 is retreated in a forward direction Y 1 from said one side of the space S in the right-to-left direction X, as shown by a solid line in FIG. 3.

The lever 8 is pin-connected, at the front end thereof, to the mounting portion 73 of the cam 7 with a pin 81 such as a rivet. The right-hand guide 5 integrally has a box-like lever holding portion 51 and a fork-like lever holding portion 52 which project to the outside of the guide 5. The lever 8 is slidably fitted in the lever holding portions 51, 52 as extending along the right-hand guide 5. The lever 8 has an operating portion 82 which is located in the vicinity of a card inserting/removing port 53 formed between the left-hand guide 4 and the right-hand guide 5.

A frame 9 is provided at the ends of both lateral sides thereof with earth terminals 91 (The left-hand earth terminal is not shown in FIG. 1). The frame 9 is provided at each lateral side thereof with hooking pawls 92 at both sides with respect to the earth terminal 91 in the front-to-back direction Y. The left- and right-hand pawls 92 and the left- and right-hand earth terminals 91 of the frame 9 are respectively put in narrow grooves 44 formed in the left- and right-hand guides 4, 5 (The narrow groove in the right-hand guide 5 is not shown in FIG. 1). The earth terminals 91 pass through the narrow grooves 44 and project downwardly from the guides 4, 5, while the pawls 92 as bent are engaged with the guides 4, 5. The frame 9 has a plurality of ribs 93, which enhance the fluxural rigidity of the frame 9.

The card C is provided in the front end surface thereof with pin insertion holes (not shown), in which disposed are contact piece groups corresponding to the contact pins groups 2A, 3A.

With the arrangement above-mentioned, while the lateral sides C1, C2 of the card C are guided by the guides 4, 5, the card C may be inserted into the card setting space S in a direction shown by an arrow F in FIG. 3, so that the pin insertion holes of the card C are inserted to the contact pin groups 2A, 3A. Then, the card C is set at a proper position in the space S. At this time, the card pushing portion 72 of the cam 7 is being moved away in the forward direction Y1.

For removing the card C, the operating portion 82 of the lever 8 is pushed with a finger to push in the lever 8 in the forward direction Y1. This causes the cam 7 to be swung around the pin 71. The swing of the cam 7 causes the card pushing portion 72 to project toward one end side of the space S in the right-to-left direction X, as shown by the virtual line in FIG. 3. At this time, the card pushing portion 72 pushes the front end surface of the card C. Accordingly, the card C is guided by the left- and right-hand guides 4, 5 and retreated, by a distance corresponding to the projecting distance of the card pushing portion 72, in the card removing direction shown by an arrow B. The card pushing portion 72 of the cam 7 merely projects toward one end side of the space S in the right-to-left direction X. This hardly involves the likelihood that the card pushing portion 72 comes in contact with the contact pins 21, 31 located in the end portions of the contact pin groups 2A, 3A. However, even though the card pushing portion 72 comes in contact with such contact pins 21, 31, the cam 7 is not electrically short-circuited with the contact pins 21, 31 and the contact pins 21, 31 are not damaged, because the cam 7 is made of synthetic resin.

When the card C is set next time, the card pushing portion 72 projecting into the space S, is pushed by the front end surface of the card C, causing the card pushing portion 72 to be moved away from the space S in the forward direction Y1.

In this embodiment, the frame 9 is useful for preventing the guides 4, 5 of synthetic resin from being expanded and opened. In the electrical connector of this embodiment, each of the left- and right-hand guides 4, 5 is made in the form of a groove. However, each of the guides may have a thickness substantially equal to that of the card C and a printed circuit board or a thin housing may be transversely disposed between the left- and right-hand guides. Even in such an arrangement, the cam 7 does not constitute an obstacle. In such an arrangement, the left- and right-hand guides are used just for preventing the card C from being positionally shifted in the right-to-left direction X when inserting-/removing the card C, and the positional shift of the card C in the thickness direction thereof is prevented by the printed circuit board or housing above-mentioned. Thus, the entire thickness of the electrical connector is made as thin as the thickness of the card C.

Figure 4:
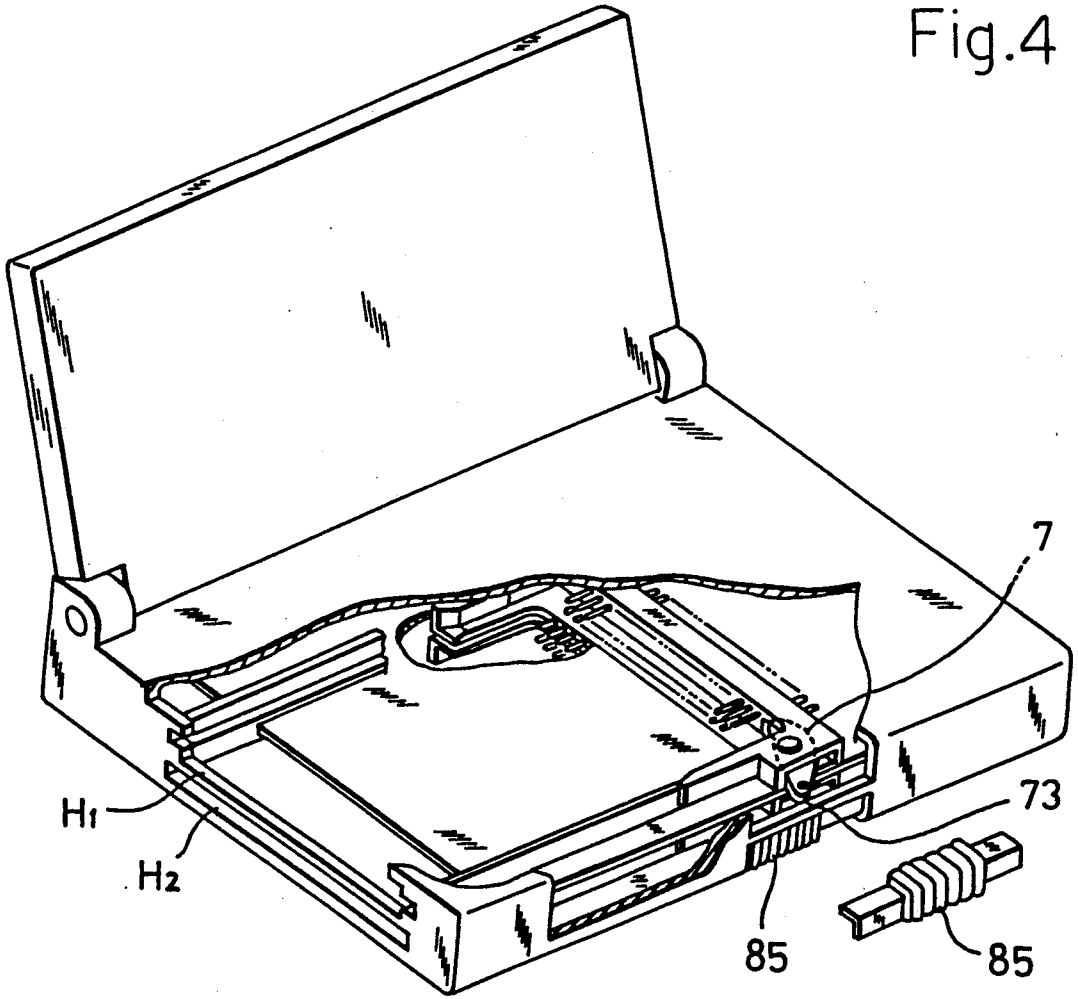
FIG. 4 is a schematic perspective view schematically illustrating the use of an electrical connector in accordance with another embodiment of the present invention.

FIG. 4 shows an electrical connector according to another embodiment of the present invention, as applied to a lap-top personal computer. In FIG. 4, two electrical connectors as overlapping each other are incorporated in a computer. The computer housing is provided in one lateral side thereof with two card inserting-/removing ports H1, H2 respectively corresponding to the two electrical connectors. Each of the electrical connectors has an operating knob 85 at a mounting portion 73 of a cam 7. At the front side of the housing, these operating knobs 85 are exposed to the operator. Accordingly, when the operator transversely moves any of the operating knobs 85, the cam 7 in association with the operating knob 85 thus moved is swung. Other arrangements and operational effects of each of the electrical connectors in FIG. 4 are similar to those of the electrical connector described in connection with FIGS. 1 to 3.

In this embodiment, even though each of the electrical connectors has an ejecting mechanism, the incorporation of the electrical connectors in a device does not cause the device to be made in a large size.

What is claimed is:

1. A multipolar electrical connector comprising:

contact pin groups;

an electrical connector body from which said contact pin groups project;

guides rearwardly extending from said electrical connector body at the ends of both lateral sides thereof, said guides being adapted to guide, in the front-to-back direction, a card provided in the front end surface thereof with pin insertion holes corresponding to said contact pin groups, while said guides respectively come in slide contact with both lateral sides of said card;

a cam swingably pin-connected to said electrical connector body at the end of the left or right side thereof;

a card pushing portion formed on said cam at a portion thereof, said card pushing portion being adapted to be moved toward or away from one end side of a card setting space in the right-to-left direction thereof when said cam is swung, said card setting space being formed between said left and right-hand guides; and a mounting portion formed on said cam at another portion thereof and connected to an actuator for swinging said cam.

2. A multipolar electrical connector according to claim 1, wherein the actuator is an operating knob disposed along and outside of one of the left and right-hand guides, and said operating knob is exposed from the housing of a device incorporating said multipolar electrical connector.

3. A multipolar electrical connector according to claim 1, wherein the cam is made of synthetic resin.

4. A multipolar electrical connector according to claim 1, wherein the actuator is a lever disposed along and outside of one of the left and right-hand guides, and the intermediate portion of said lever in the front-to-back direction is fitted, slidably in the front-to-back direction, to lever holding portions which project outwardly from the guide along which said lever extends.

5. A multipolar electrical connector according to claim 4, wherein the cam is made of synthetic resin.

6. A multipolar electrical connector according to claim 1, wherein each of the left and right-hand guides has a thickness substantially equal to that of a card, and a printed circuit board is transversely disposed between said left and right-hand guides.

7. A multipolar electrical connector according to claim 6, wherein the cam is made of synthetic resin.

8. A multipolar electrical connector according to claim 4, wherein each of the left and right-hand guides has a thickness substantially equal to that of a card, and a printed circuit board is transversely disposed between said left and right-hand guides.

9. A multipolar electrical connector according to claim 8, wherein the cam is made of synthetic resin.

10. A multipolar electrical connector according to claim 1, wherein each of the left and right-hand guides has a thickness substantially equal to that of a card, and a housing is transversely disposed between said left and right-hand guides.

11. A multipolar electrical connector according to claim 10, wherein the cam is made of synthetic resin.

12. A multipolar electrical connector according to claim 4, wherein each of the left and right-hand guides has a thickness substantially equal to that of a card, and a housing is transversely disposed between said left and right-hand guides.

13. A multipolar electrical connector according to claim 12, wherein the cam is made of synthetic resin.

* * * * *